United States Patent [19]

Rese et al.

[11] 4,010,868

[45] Mar. 8, 1977

[54] APPARATUS FOR THE AUTOMATIC ISSUANCE AND RETURN OF KEYS

[75] Inventors: Arkadijus Rese, Gossau, St. Gallen, Switzerland; Hermann Eberhardt, Syrgenstein, Germany

[73] Assignee: Eberhardt & Co., Giengen, Germany

[22] Filed: May 12, 1975

[21] Appl. No.: 576,895

[30] Foreign Application Priority Data

May 27, 1974 Germany ..... 2425487

[52] U.S. Cl. ..... 221/9; 221/240; 221/312 A

[51] Int. Cl.[2] ..... B65H 7/02

[58] Field of Search ..... 221/240, 266, 253, 279, 221/312 R, 312 A, 9; 194/10; 198/136, 160, 212; 70/356 R, 356 B

[56] References Cited

UNITED STATES PATENTS

| | | | |
|---|---|---|---|
| 3,050,214 | 8/1962 | Kopf | 221/240 |
| 3,119,484 | 1/1964 | Davis et al. | 221/312 X |
| 3,176,817 | 4/1965 | Perrella et al. | 221/240 X |

*Primary Examiner*—Stanley H. Tollberg

[57] ABSTRACT

A plurality of keys are movably suspended on a support in successive orientation one behind the other. The leading key engages a dispensing device which normally prevents the discharge of the keys from the support but which is actuable on command to selectively release the first or leading key while retaining the remainder of the keys on the support. Secondary rails are provided for separating and diverting keys according to their use.

41 Claims, 12 Drawing Figures

APPARATUS FOR THE AUTOMATIC ISSUANCE AND RETURN OF KEYS

BACKGROUND OF THE INVENTION

The present invention relates to apparatus for the storage and automatic issuance, on command, of keys, particularly for use in public institutions.

Automatic key issuing machines have been utilized in public establishments, such as bathhouses and the like to enable customers to attain access to the various facilities, independent of any service personnel. Such apparatus may for example provide, on payment of a given fee, entrance to the bathhouse generally as well as the issuance of a particular key to a clothing locker or to a dressing compartment or cabin. On leaving the bathhouse, the customer returns the key to the apparatus, usually by merely throwing the key through a receiving slot from which the machine automatically collects, scans, sorts and passes the key to a storage device from which it may be reissued to a subsequent customer. The present machines by which keys are automatically collected and sorted upon their return, and by which they are further distributed and reissued are constructionally very complicated, costly to maufacture, and are liable to frequent breakdown resulting in costly maintenance.

It is an object of the present invention to provide apparatus for the storage and automatic issuance of keys, of the above mentioned type, which overcomes the disadvantages of the prior art devices and which is simple in construction, and inexpensive to manufacture.

It is another object of the present invention to provide apparatus, particularly adaptable for use in public installations, by which keys can be automatically retrieved and sorted and subsequently reissued, on command and without the intervention of any personnel.

The foregoing objects, other objects, together with the numerous advantages of the present invention, will become apparent from the following disclosure.

SUMMARY OF THE INVENTION

According to the present invention apparatus is provided comprising a support having an entry and an exit terminus on which a plurality of selected keys can be movably suspended one behind the other. A dispenser is located prior to the exit terminus, which is actuable on command to automatically separate the leading key from those remaining on the support and to cause the leading key to be removed therefrom.

In the simplest form, the support, may preferably consist of an elongated rail and the key is provided with an aperture, or a slide member attached thereto having an aperture, which is adapted to slidingly fit over the rail. The rail is arranged so as to be inclined with respect to the horizontal allowing the keys to move on the rail by their own dead weight, under the action of gravity. In the simplest form the rail can have an I-shaped cross section and the aperture provided in the key, or in the slide member attached thereto can be merely provided with a central hole and a laterally extending slot so that it can slide onto the rail.

According to the present invention, the dispensing means comprises a circular or cylindrical roller arranged adjacent the rail support so that its outer periphery is adapted to engage the keys moving thereon. The roller is provided with a slot running in a generally axial direction so that the foremost one of the keys on the rail is caused to enter into the slot, on rotation of the roller, so as to be separated from the succeeding keys, while the peripheral surface of the roller engages the next succeeding key holding all of the keys thereon to the rail.

In general, keys are formed with a closed circular loop or hole at the time of their manufacture, while hole is not easily altered to form a slide aperture capable of funtioning in the present invention. Accordingly, it is preferred that an additional slide member be normally attached to the key. The slide member, namely a tag is formed with the necessary aperture capable of being received by the supporting rail, also provides visual indicia, such as the locker or cabin member or other identifying information, which can be easily read by the customer. In the present disclosure a tag is employed as the slide member. However, it will be appreciated that the present invention need not be limited in this respect.

To insure proper and correct placement of corresponding keys on a particular supporting rail, belonging to predetermined facilities, as for example the separation of men's and women's locker keys an alignment guideway, matched in cross section to the aperture in the tag (or key) is provided at the entrance terminus. The guideway acts on the one hand to assist the transfer of the key from the customer to the corresponding supporting rail and on the second hand may be provided with means for sensing the nature of the key. A simple sensing means, as employed by the present invention, comprises providing on both the guideway and the tag suitable cooperating coding means, for instance predetermined projection and/or recesses which permit only predetermined keys or predetermined groups of keys to be transferred over the guideway onto the supporting rail, corresponding to a respective group of keys.

The dispensing means, comprising the roller, is preferably electrically operated and is thus actuable in response to a coin receiving means, or through the operation of a turnstile, or other simple devices.

In those instances where it is not possible to pass the key from the entrance guideway to the exit end of the rail, that is of the supporting rail, by dead weight or gravity alone, the supporting rail may be provided with a mainly horizontal portion in addition to the inclined portion, on which the keys may be forced to slide by a motor driven catch means. In one instance the catch means may be attached by suitable mount, to a continuous belt, adapted to run over a pair of spaced pulley members arranged in the plane of the horizontal rail portion. The catch is pivotally secured on the mount and is magnetically actuated into a working position wherein it moves behind the tag on a key, on the upstream side of the rail so that on movement of the belt it will cause the key to slide toward the inclined portion of the rail. The catch is released from its working position by means of a stop member arranged along the length of the rail so that it may if desired, be carried around the horizontal portion of the rail without inerfering with the remaining keys. The catch may be then pivoted back into its working position by means of another stop member, collar or other magnet at a predetermined position on the horizontal rail so as to move a succeeding key. If required, the magnet can be released free of the return of the key.

In another embodiment, the horizontal portion of the rail may be replaced with a spiral portion on which the slides or keys can also be moved by the use of a motor driven catch. It is advantageous in this instance for the catch to be arranged to move rotatably as well as axially on a motor shaft which extends along the central axis of the spiral. The motor shaft is preferably hollow and has arranged within it a weight which can be moved in the axial direction by means of a cord guided over a pulley arranged at the upper end of the shaft. Stop means are located at both the upper and lower ends of the shaft which are adapted to place the catch in operative or inoperative position, as the case may be when they reach the respective extremities.

In general, the present invention is adopted to be employed in a system capable of issuing and dispensing keys for various facilities. The keys from several different groups must thus be sorted and divided into given predetermined categories and stored on separate and independent supporting rails. Accordingly, in accordance with one form of the present invention there may be provided a system wherein a main introductory supporting rail, receives all of the keys irrespective of their category and wherein means are provided by which the keys can be respectively transferred to a specific one of a plurality of rail supports, each provided with its own dispensing means actuable only upon the satisfaction of a given set of initiating circumstances.

Full details of the present invention, together with a specific description of its preferred embodiments are set forth in the following disclosure, and will be seen in the accompanying drawings.

DESCRIPTION OF THE INVENTION

Figure 1:
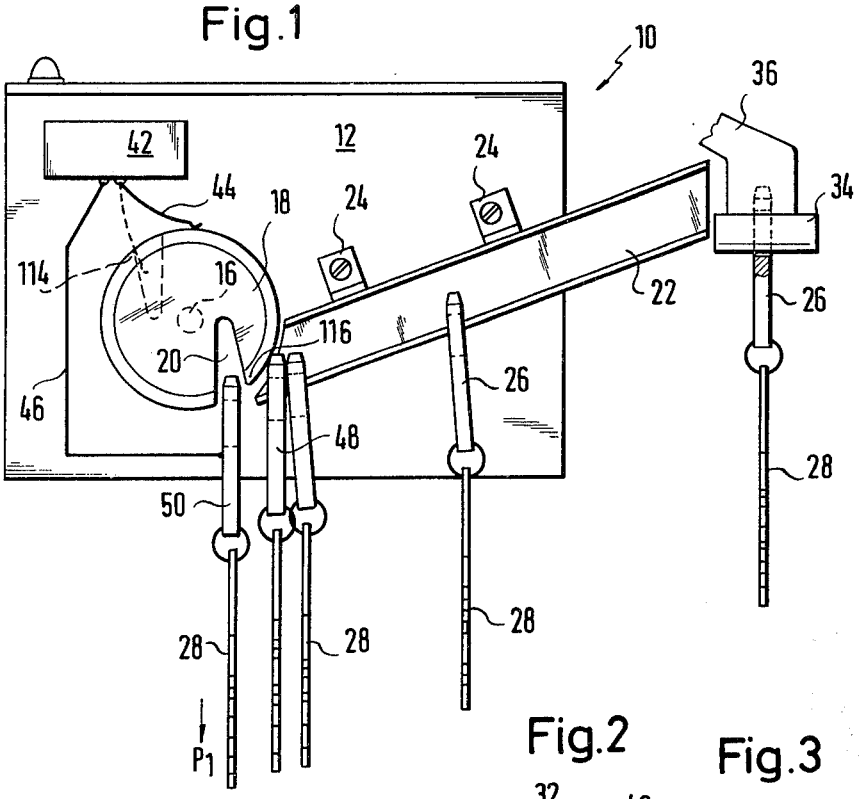
FIG. 1 is an elevational view showing in schematic form the preferred embodiment of the present invention.

The apparatus, indicated generally by the numeral 10 in FIG. 1 comprises a housing 12 made of metal, or plastic, of suitable, hollow, rectangular shape. Mounted within the housing 12 is an electric motor 14 having a shaft 16 protruding through the housing wall. Fixedly attached to the shaft 16 is an enlarged cylindrical roller 18, preferably made of an appropriate plastic material. The roller 18 is provided with a central splined bore which fits over a correspondingly splined shaft 16, thus fixing the two for conjoint rotation while permitting the roller to be easily removed. The roller 18 is provided with a triangularly shaped slot extending along the axial length of the roller. The slot 20 has a depth approximately equal to the radius of the roller 18 and in the direction of rotation, indicated by the arrow A, is provided with a leading edge which extends substantially chordally to the central axis and a trailing edge which extends at an angle thereto, thus providing a relatively wide opening extending parallel to the axis of rotation transversely of the roller on the peripheral surface.

Figure 2:
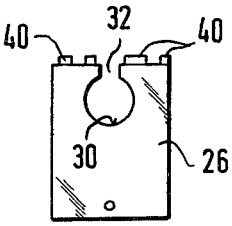
FIG. 2 is a side elevational view of the slide tag, adapted to be attached to the key.
Figure 3:
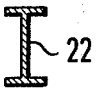
FIG. 3 is a cross sectional view of the supporting rail of FIG. 1 taken along lines 3—3.
Figure 5:
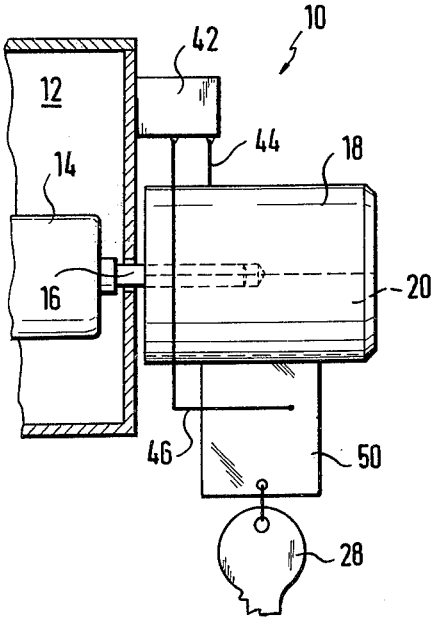
FIG. 5 is a view of the apparatus of FIG. 1 taken along line 5—5.

A rail 22, affixed by attachment brackets 24 to the wall of the housing 12 is provided for supporting the key tags 26 to which the keys 28 are attached. The rail 22 is provided with an entrance end and an exit end and is arranged at an angle inclined so that its exit end extends downwardly toward the cylindrical roller 18, permitting the keys 28 to slide under action of gravity from one end to the other. The rail 22 has an I-shaped cross section as seen clearly in FIG. 2, while each of the tags 26, to which the keys 28 are attached are provided with a circular opening 30 and an upwardly extending slot 32 of such a dimension that they may be slidably placed over the lower transverse section of the I beam forming the rail 22 in suspended fashion, as illustrated. The employment of slide tags 26, is made for convenience only, since keys, are normally fashioned during manufacture with a small loop or closed eyelet allowing the attachment of such tags, but not easily allowing their modification so as to conform to and slidably fit over a supporting rail. It will however be appreciated that if desired, keys can be fashioned, during their manufacture with suitable openings or apertures of the type shown on the runner of FIG. 2. The use of a tag or similar member serves several other benefits, namely the ability to provide visual indicia of identifying the key and to serve simultaneously as an appropriate means by which the customer may attach the key to his costume or bathing suit.

Figure 4:
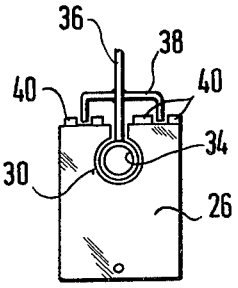
FIG. 4 is a sectional view taken along line 4—4 of FIG. 1 showing the entrance guideway and the operative relationship of the coding means thereon on the tag.

In general, a plurality of supporting rails will be employed in a single system. Each of the supporting rails will be of a length sufficient to hold a predetermined number of keys which in turn will belong to a predetermined group or relate to a given facility, such as the men or women's changing cabins respectively. For the purpose of facilitating the transfer of the keys upon the respective rails, there is provided an aligning rail 34, supported on a suspension arm 36, as seen in FIG. 4. The aligning rail 34 and suspension arm 36 may be mounted on a suitable frame so as to be traversable between the entrance terminus of each of the rails 22 either manually or automatically by appropriate signal. The aligning rail 34 has a cross section, corresponding to the shape and size of the aperture 30 in the tag 26. But is dimensioned so as to provide sufficient play allowing the tag to be freely moved along the aligning rail 34 without however permitting its canting or twisting prior to transfer onto the rail 22.

In order to insure that only keys of a certain group, for instance those designated to unlock or lock the gentlemen's dressing compartments, be transferred onto the corresponding predetermined supporting rail 22, the aligning members 34 and 36 and the tag 26 are provided with cooperating sensing and coding means. In the embodiment shown in FIGS. 1 through 5, laterally extending arms 38 project from the suspending arm 36 adjacent to the upper edge of the tag 26. This upper edge of the tag 26 is provided with upwardly projecting members 40 which are arranged in a predetermined number and size to provide grooves or cavities between them which cooperate with the laterally projecting arms 38 to identify and discriminate between the keys and to permit passage only of the keys of a certain group. The coding on the tags of those keys in a predetermined group is identical so that the sensing arms 38, mounted on the suspension arm 36 will permit only those keys which are appropriately coded to be transferred from the aligning rail 34 to the corresponding rail 22. Other groups of keys, for example those for the women's cabins, children's cabins, etc. for clubs, schools, etc. have different coding means. Although these codings will be identical among themselves, they will be required to match only the corresponding sensing means provided on the aligning rail 34 for their appropriate supporting rail 22.

Returning to FIG. 1, there will be seen mounted on the front wall of the housing 12 a switch 42 from which extend a pair of switch arms 44 and 46. The switch arm 44 lies on the peripheral surface of the cylindrical roller 18 and is adapted to sense the rotation of the roller 18 presenting the transverse slot 20. The switch arm 46 extends below the roller and is adapted to sense the presence of a key at a predetermined point in its movement. The switch 42 may be formed as a microswitch, the switch arms 44 and 46 being mechanical in nature. However, it will be obvious that the switch arms 44 and 46 can be replaced by switch contacts rather than being mechanical in nature would be purely electrical in nature.

The apparatus according to FIGS. 1 through 5 operate as follows:

A customer, having made use of the facilities, bathhouse, and is ready to leave, takes his key and slides it onto the aligning guideway by placing the aperture 30 onto the aligning rail 34 as seen in FIG. 4. If the coding lugs 40 on the upper edge of the slide tag 26 matches the sensing arms 38, the bather is then permitted to continue sliding the key onto the supporting rail 22. To avoid unnecessary complication of the coding and sensing means, it may be assumed that separate systems will be employed for each of the men and women facilities.

Once the key is transferred to the supporting rail 22 the key slides due to its own dead weight downwardly on the supporting rail until it reaches the exit terminus and strikes the periphery of the roller 18. In the event, other keys happen to have preceded the key in question, the key then comes to rest against the preceding key before it reaches the roller 18. The roller 18 is normally stationary and in this stationary rest position the slot 20 is directed upwardly, as seen by the dotted lines so that the leading key on the rail will assuredly come to rest against the peripheral surface of the roller 18. In this rest position the switch arm 44 falls into the slot 20 and comes to rest against the trailing edge, indicated by the dotted line 114 in FIG. 1.

When a second would be bather comes along, and pays the required fee for example at a coin operated turnstile, the motor 14 is selectively activated causing the cylindrical roller 18 to be rotated clockwise. The roller 18 rotates until the slot 20 passes the exit terminus of the supporting rail 22, which as seen in FIG. 1 is shaped to conform to the peripheral edge of the roller 18 and the foremost one of the tags 26 becomes situated in the mouth of the slot 20. Because of the shape of the slot 20 the leading edge of the slot passes over the tags 26 and only the trailing edge of the slot 20, indicated by the reference numeral 116 in FIG. 1 is caused to engage the tag of the foremost key between the foremost and the next succeeding key. The slot 20 thus positively seizes only the first key separating the same from the remaining keys suspended on the supporting rail and removes the same from the supporting rail 22, as indicated by the position of the key 50 in FIG. 1. The peripheral surface of the roller 18 immediately engages the next succeeding key, indicated by the reference numeral 48 holding it on the supporting rail 22 and preventing it and all of the remaining keys from being removed. The removed key 50, on rotation of the roller 18, is placed in a position so that having lost its support on the rail it now drops freely downward in the direction of the arrow P1. Preferably an ejection shaft and a delivery tray, neither of which are shown in the drawing, are employed so that the key 50 can be adequately presented to the customer. The width of the slot 20 is selected so that there is sufficient play between the tag and the walls of the slot 20 preventing any jamming of the tag within the slot. The roller 18 once activated, continues to rotate for one full revolution until the slot 20 has returned to its upwardly directed position, indicated by the dotted lines, and until the switch arm 44 comes to a rest position on the surface 114. The counterclockwise snapping, of the switch arm 44 onto the surface 114 causes the switch 42 to deactivate the motor 14 bringing the dispensing roller 18 to a standstill. Thus, the activation of the motor 14 is intermittent and the dispensing roller 18 rotated for only one revolution at a given time allowing only one key at a time to be dispensed.

During the ejection of the foremost key, here denoted by the numeral 50, the next key, here denoted by the numeral 48, is moved forward, under the effective gravity, until it comes to rest on the periphery of the roller 18. Should the succeeding key 48 attempt to jam or catch slightly with the moving roller, the shape of the peripheral surface of the roller 18 causes it to be moved or jiggled slightly backward which acts also to straighten and align the keys remaining suspended on the supporting rail.

The contact arm 46 determines the presence of at least one key on the supporting rail. This arm 46 normally rests against the front foremost key and is pivoted in a counterclockwise manner at a predetermined preset angle to activate the switch 42. In the absence of a key on the rail 26 the switch arm 46 is biased to move in a counterclockwise direction causing the switch 42 to prevent rotation of the dispensing roller 18 by controlling the operation of the motor 14. The next cycle of operation, is initiated when the next bather or customer has paid his fee to use the installation, and there exists a key and a supporting rail 22. Thereby the dispensing roller 18 is once more set in motion and once more the foremost key is suitably ejected.

Figure 6:
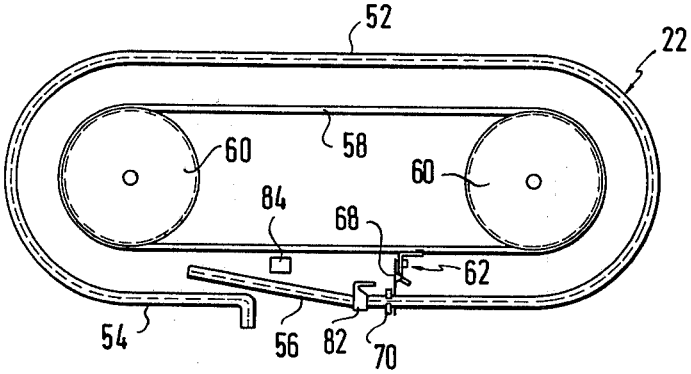
FIG. 6 illustrates a modified form of supporting rail, having a horizontal section and motor driven means for shifting the keys therealong.
Figure 7:
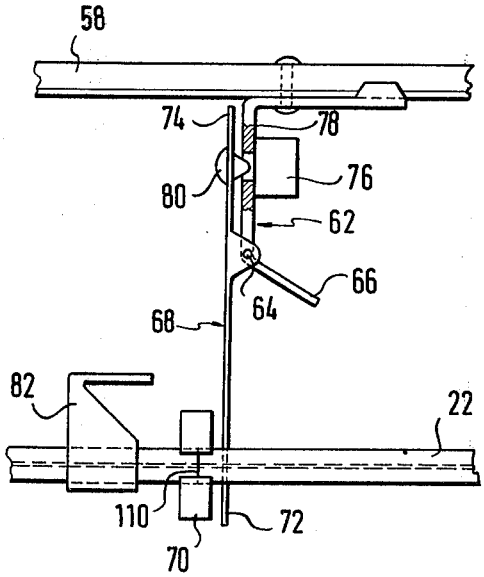
FIG. 7 is an enlarged view of a portion of the apparatus shown in FIG. 6 illustrating the magnetically operable catch for shifting the keys.

In the embodiments shown in FIGS. 1 through 5, it is intended that the key be slidable from the point of insertion onto the supporting rail 22 by means of gravity. It will of course occur in certain instances wherein this is not possible, by reason of constructional limitations, spacial limitations, so that the movement of the key on the supporting rail will have to be assisted. In FIGS. 6 and 7 such a modified construction is shown. In FIG. 6, the supporting rail has a substantial horizontal portion 52, in the form of a loop enabling the storage thereon of a substantial number of keys. The horizontal portion 52 can of course assume other shapes other than that of a loop. At the rear end of the horizontal portion 52, there is provided an upwardly inclined portion 52 onto which the keys may be slided and which allow the keys to fall by gravity, albeit through a limited distance onto the horizontal portion 52. At the forward end of the rail, the downwardly inclined portion 56 is provided which downwardly inclined portion 56 leads to the dispensing or ejector roller 18, seen in FIG. 1, but not shown in FIG. 2. If necessary, the ejector or downwardly inclined portion 56 can also lead to a further following horizontal portion similar to that of 52 so that two or more horizontal portions 52 may be stacked one upon each other to increase the storage capacity of the system within a given area. Preceding the entrance portion 54, aligning means such as that shown in FIG. 1 by the tubular rail 34 and suspending arm 36, may be also provided.

Within the loop formed by the horizontal portion 52 and lying in a plane substantially parallel to it is a belt 58 (eg, a vee belt) which is entrained to run around a pair of pulleys 60 spaced with respect to each other. One of the pulleys 60 is connected to a motor, (not shown) so that it may be driven. Attached to the belt 58, is a shifting mechanism 62 adapted to shift or move the keys along the horizontal rail portion 52 from its insertion end 54 to the ejection portion 56. The shifting mechanism is seen in greater detail in FIG. 7 and comprises a mounting bracket 63 which is riveted firmly to the belt 58 so that it is conjointly carried with it. At a point laterally spaced from the belt 58 the bracket 63 is provided with a pivoting pin 64 to which is mounted for pivotal movement a catch 68. The catch 68, fulcrumed about the pivot point 64 comprises a simple lever having one end 72 extending normally beyond portion 52 so that it can engage behind a key, indicated by the reference numeral 70 in FIG. 7. The opposite end of the catch 68 extends toward the belt 58 and is adapted to come into contact with the mounting bracket 63. A magnet 76 is mounted on the bracket 63 while a similar magnet 80, or a piece of magnetic material, is attached to the end 74 of the catch 68. In this manner the magnetic action between the magnets 76 and 80 will normally hold the catch 68 in perpendicular or transverse relationship with respect to the belt 58 and the rail 52. The end 66 of the supporting bracket 63 is bent inwardly from the pivoting point 64 and provides a stop for the counterclockwise movement of the catch 68. The strength of the magnets 76 and 80 are such that the catch 68 will not be pivoted even though a plurality of keys 70 are shifted along the rail 52 and movement of the belt, in the direction of the arrow B.

Beyond the point, indicated by the reference numeral 110, where the horizontal portion 52 of the rail enters in transition to the downwardly inclined portion 56, there is arranged a stop member 82. The stop member 82 is mounted on a frame or support above the run of the rail members 52 or 56 so as not to interfere with the movement of the keys 70 but is provided with a downwardly directed end portion which is adapted to engage the forward end 72 of the catch 68. Thus on movement of the catch 68, beyond the transition point 110, the stop 82 forces the catch 68 to pivot about the pivot axle 64 so that the catch 62 is moved out of its working position behind the keys 70. The limit of the inactive position is defined by the end 66 of the mounting bracket 63. The movement of the forward end 72 to its inactive position permits the keys 70 to be freely released and thus to drop onto the downwardly inclined portion 56 free of inerference or forward movement by the catch 68. A second stop member 84, which if desired may also be a magnet, is positioned adjacent the run of the belt 58 so that it causes the return movement of the catch 68, after it passes the transition point so that the catch 70 may be returned to its active position prior to the transition of the downwardly inclined entrance portion 54 into the horizontal portion 52. Thus, although the catch 68 runs beneath the rail portion 52, the stop members 82 and 84 act respectively to shift the catch 68 from an active to an inactive and then again back to an active position whereby those keys suspended on the horizontal portion 52 can be moved from the entrance position defined by the portion 54 to the exit or ejection position defined by the portion 56.

The embodiment according to FIGS. 6 and 7 operates as follows.

After leaving the facility, the customer places his key, i.e. the slotted tag indicated by the numeral 70, on the upwardly inclined portion 54 of the rail **22*a*. The key then slides by its own weight toward the horizontal portion 52 where it comes to rest at the elbow or transition portion. The belt 58 is then caused to rotate in a clockwise direction, as seen by the arrow, carrying the catch 68 with it. As the catch 68 passes the transition zone between portions 54 and 52 it engages the depending tag 70 and pushes the key along the horizontal portion towards the downwardly directed portion 56, where the key again falls because of its own weight. At this point the catch 68, engages the stop member 82, which pivots it out of its working position, i.e. out of its perpendicular position crossing the run of the rail 22*a*. The catch thus pivots, counterclockwise about the pin 64 until it engages the finger 66**, as described above.

The key, having reached the downwardly inclined portion 56 falls until it reaches the ejector roller, as described in connection with FIGS. 1 to 5, or if necessary to accumulate large numbers of keys, to another section of horizontal rail **22*a* interposed prior to the ejector roller. The catch 68, continuing the move with the belt 58, remains in the inactive position, until it reaches the second stop 84 where it may be again pivoted back into its working position. Precautions may however be taken to ensure that the catch 68, will continue to move past the second stop 84 in its inactive position, in the absence of a key on the rail or for other reasons, and that it be caused to assume its active position only when a key is on the rail. Switch means, (e.g. a micro switch) can be placed adjacent the upwardly inclined intake portion 54 to sense the insertion of a key on the rail, which switch means will then actuate the second stop means 84 (preferable electromechanical) to engage the end 74 of the catch 68 causing it then to pivot counterclockwise. The catch 68** is then pivoted back into the active position, shown in FIG. 7, where it is held securely by action of the holding magnet 76.

On the other hand, provision can be made to actuate the second stop, immediately, upon the key falling on the downwardly inclined portion 56, so that the catch 68 is replaced into active position immediately, once the catch clears the area of the downward inclined portion 56. Finally, it is also possible to provide suitable switch means which will operate to deactivate the drive motor for the belt 58, once the key has reached the downward incline, and in the absence of there being fed any other key to rail. Thus the belt 58 can be stopped and the catch 68 remains in inactive position during the intervals between customers.

Figure 8:
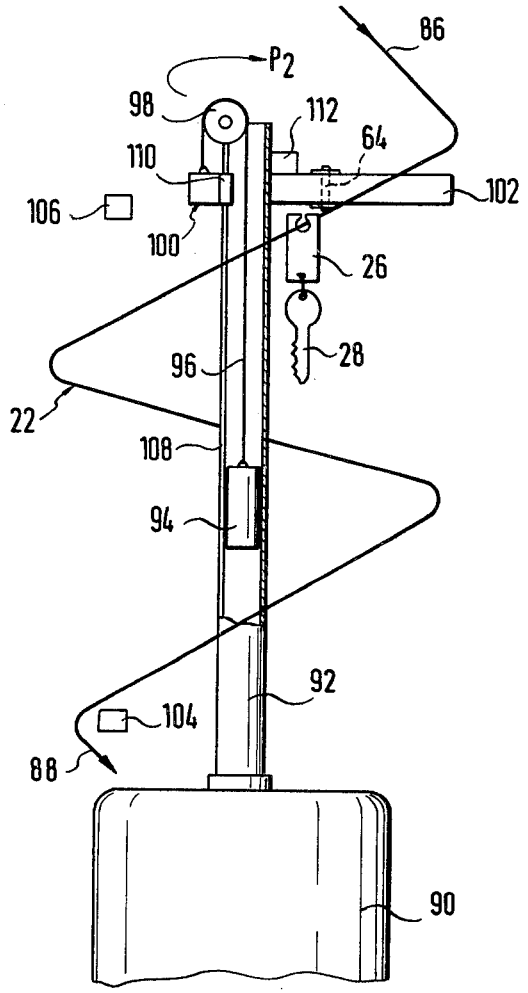
FIG. 8 illustrates a second form of supporting rail having a spiral section and motor driven means for shifting the keys therealong.

In FIG. 8, an embodiment for the forced transport of key from an intake section to the storage rail is shown. Here the intake rail comprises a helicordal shaped rail 22*b* having an initial inlet section 86 and a terminal outlet section 88. In practice, the slope of the intermediate spiral of the helicordal rail 22*b* will not be sufficient, to allow the keys to fall by the action of gravity alone. The slope of inlets and the outlet portions 86 and 88 however, are more acutely inclined, so that they do. The outlet portion 88 leads to the ejector roller, earlier described, or another intermediate, holding rail, if desired.

The spirally shaped rail 22*b*, is of such diameter that there may be arranged, vertically along its central axis a hollow motor shaft 92 connected to the rotor of an electric motor 90. A deadweight 94, is freely arranged within the hollow shaft 92 and a rope 96 connected at one end to the weight, is entrained over a pulley 98 journalled at the upper end of the shaft 92. The upper end of the shaft 92 is cut out, with a slot or recess, so that the pulley 98 can freely rotate. The rope is connected at its other end to a supporting bracket 100 which is adapted to move up and down on the shaft 92. The shaft 92 is provided with a longitudinal slot 108 running on its outer surface and the bracket 100 is provided with a flange or similar projection 110 capable of freely sliding in the slot 108. Thus the bracket 100 may freely move axially along the shaft 92, without becoming dislodged, during simultaneous rotation of the shaft 92 caused by the drive of motor 90.

The bracket 100 is provided with a lateral extension at the end of which is secured a pivotal hinge 101 which a catch 102 is also connected. The catch 102, and its operation, is preferably similar to that shown in FIGS. 6 and 7, there being also provided on the bracket 100 and its extension suitable magnets, to maintain the catch 102 selectively in working or active position. The hinge 101 pivots about an axis parallel to that of the shaft 92, causing the catch 102 to move either toward the spiral rail 22*b* (active position) or away therefrom (inactive position).

At the upper end of the rail there is provided a first stop member 106, which is adapted to pivot the catch 102 into active position substantially at the elbow or transition between the inlet portion 86 and the spiral rail 22*b*. Similarly, a second stop 104 is located at the lower end of the helicord adjacent the elbow or transition between the spiral rail 22*b* and the outlet portion 88. The second stop 104 is adapted to move the catch 102 into the inactive position. As in the embodiment of FIGS. 6 and 7, the stop 104 and 106 of this FIG. 8, are electro-mechanical (solenoid actuated push rods for example) or purely magnetic in nature, and are capable of acting on the catch 22 in response to electrical signals from switch means or sensors determining the presence or absence of keys on the rail. A rest stop 112 is fixed on the upper end of the shaft 92, to hold the catch 102 in inactive position at that point.

The embodiment of FIG. 8 functions as follows:

The motor 90 is preferably premanently switched on (although not necessarily so). As a result the motor shaft 92 rotates clockwise, in the embodiment. In the absence of any key on the rail 22*b*, the catch 102 is maintained in an inactive position at the top of the shaft 92, (i.e. resting on the stop 112) and rotating with the shaft 92. It is to be noted that when inactive, the catch 102 has an overall length less than that of the radius of the spiral rail, so that it will freely rotate within the confines of the rail, without binder. When the customer returns the key by slipping the tag onto the inlet portion 86, the key slides downwardly on to the spiral rail 22*b*. The key is there sensed, by a micro switch, or other sensor such as a photo cell, and a signal provided which activates the upper stop 106, which on the next rotational passage of the catch 102, pivots the catch into its active position. It should be noted that the catch 102 has an overall length greater than the radius of the spiral rail 22*b*, so that it protrudes somewhat beyond the latter. After the catch 102 has been brought into its active position, it no longer can freely rotate within the spiral, but because it protrudes laterally, as seen in the Figure, it bears in engagement against the spiral rail surface. On further rotation of the shaft 92, the catch 102 is vectored so that it is caused to follow the contour of the rail. The weight 94 maintains the catch 102 and bracket in engagement with the rail 22*b*, with a certain bias, enabling the catch 102 to move downwardly with a firm, steady pace, pulling the weight 94 upwards. Consequently, as the catch 102 travels downwardly, it engages behind the illustrated key 26, moving the key in a positive manner toward the outlet portion 88.

The drawing illustrates only two turns in the spiral rail, however, it will be understood, that for practicable purposes the rail may be formed of many more turns, than that. Once the key reaches the outlet portion 88, it drops downwardly of its own weight to the ejector roller, not shown in this Figure, although obvious from FIG. 1.

Once the catch 102 reaches the region of the outlet 88, the catch 102 is moved into the inactive position, in much the same way as shown in connection with FIG. 7. In this inactive position the catch 102 no longer rests on the rail surface, being pivoted back into a position where its length is less than that of the radius of the spiral rail. Being thus free of contact with the rail the weight 94 is caused to freely fall carrying the bracket 100 up the shaft to the top, where it again comes to rest again the rest stop 112. To prevent the rapid fall of the weight 94 and the too rapid rise of the bracket 100, suitable dampening means, e.g. springs, brakes, etc. can be provided, preferably connected to the pulley 98, or its mounting shaft.

Once the bracket 100 and the catch 102 are returned to its upper position, it remains in the inactive position (i.e. folded over) rotating with the motor shaft 92, until reactivated by the insertion of another key on the inlet portion 86. When this occurs, the upper stop 106 is again activated moving the catch 102 back into its active operating position.

In the embodiments of both FIGS. 6, 7 and 8 respectively, provision can be made to provide the key tag with coding means whereby the keys may be mechanically sorted on to selective rails. The inlet rails and the tags may be provided with the same means as illustrated in FIGS. 1 – 5.

Figure 9:
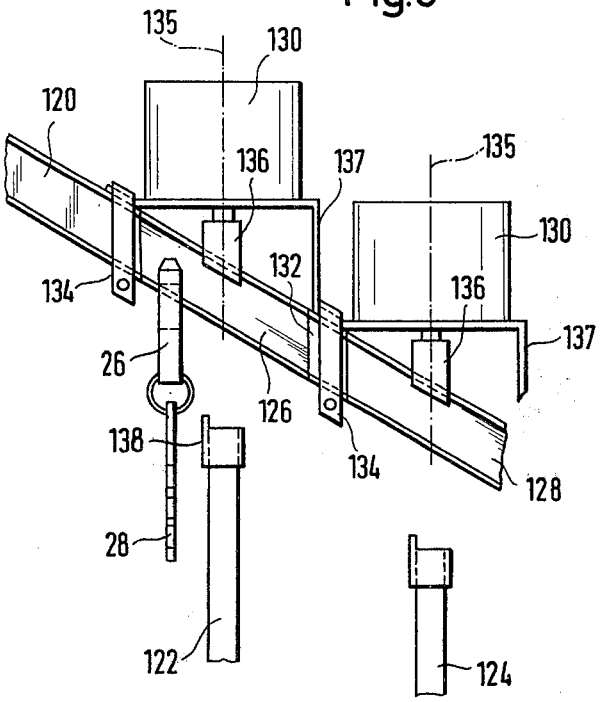
FIG. 9 is an elevational view of a portion of a rail supporting system by which keys may be distributed among different rails.
Figure 10:
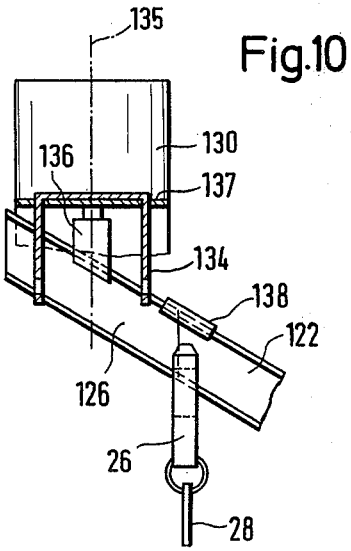
FIG. 10 is a side view of the arrangement illustrated in FIG. 9.
Figure 11:
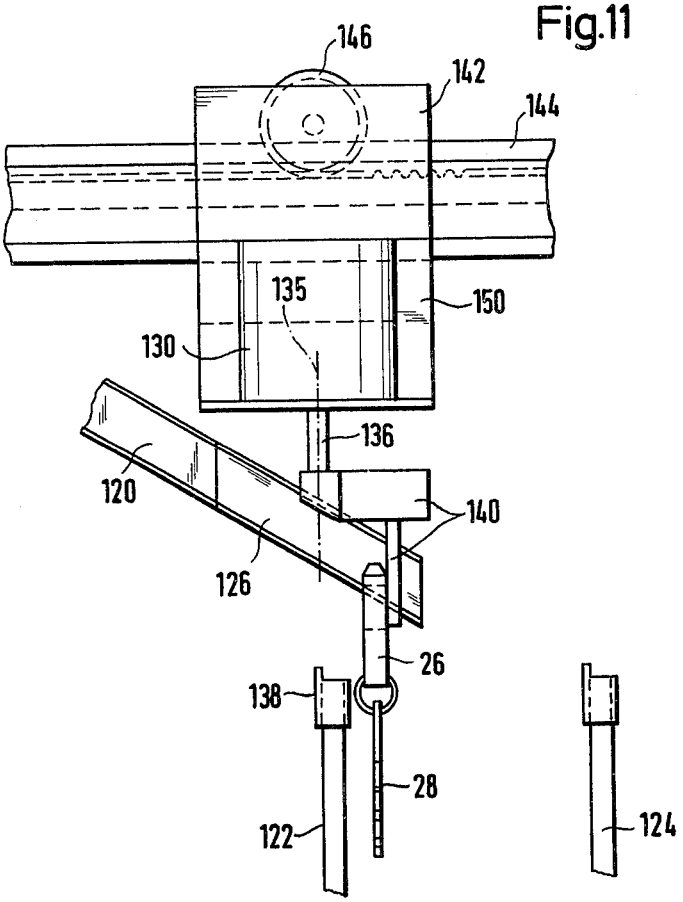
FIG. 11 illustrates a modified form of the apparatus shown in FIG. 9.

On the other hand, in accordance with a further embodiment of the present invention, as shown in FIGS. 9 through 11, provision can be made for automatic sorting of the keys. Thus, all the keys can be indiscriminately returned to a single main intake rail, illustrated in FIGS. 9 – 11 by the numeral 120 from which it can be selectively directed to the particular storage rail.

FIG. 9 illustrates a distribution device, in which the main intake rail 120, is followed by several, separate but aligned rail sections of which two, 126, 128 are shown. The main intake rail 120 is inclined so that the keys will slide of their own weight, similarly the sections 126 and 128 are aligned at the same angle. Interposed between the aligned sections 126, 128 and others, is a fixed section 132, on which a U-shaped frame 137 is fixed. The frame is preferably a bent loop of sheet metal, capable of supporting on its upper surface a rotary magnet 130, from the central axis 135, of which extends a shaft and clamping bracket 136 which is fixedly mounted to the upper transverse section of the rail. As in the other embodiments, the rail is preferably in the form of an I beam. In this manner, each of the sections 126, 128 etc. can be made to rotate about the axis 135, which is vertically directed, as seen from the drawings.

Arranged transversely to the normal alignment of intake rail 120 and sections 126, 128 etc. (preferably transverse thereto, although other angular dispositions may be used) are a plurality of secondary receiving rails, of which only two, 122, 124, are shown. Each of the secondary rails 122, 124 etc. forms a magazine or storage rail for a particular group of keys. For example, one may be for the keys to children's lockers, another for women, and another for men. Each of the secondary rails are also inclined to allow the keys to slide freely thereon and fall by their own weight. Each secondary rail further leads toward an ejector roller, for issuing the keys on command, as illustrated in FIG. 1 The secondary rails 122 and 124 are arranged so that they will be aligned with one or more pivotal rail sections 126, 128, etc. in a predetermined manner, preferably in a one to one relationship, when the pivotal rail sections are moved from the main rail. The secondary rails can be provided, along their upper edges, with a flange like stop member 138 against which the pivotal rail sections can strike and be limited in their movement.

Figure 12:
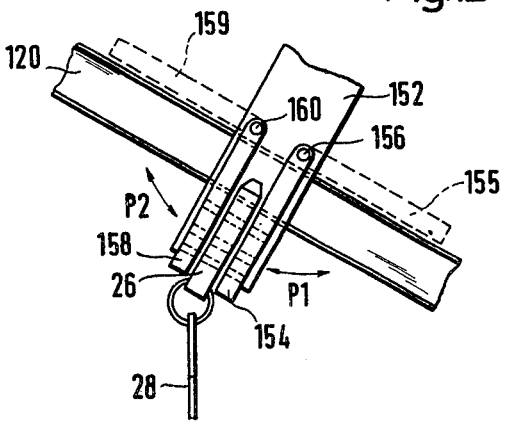
FIG. 12 illustrates scanning means for sensing the coating indicia contained on the key or their slide key tabs.

Prior to each of the pivotal rail sections 126, 128 etc., there is mounted about the rail and spaced therefrom a frame in which is mounted a light barrier 134 in which is mounted a photo cell capable of sensing the passage of a key along the rail. Along the main rail 120, preferably at its intake bend, there is mounted a scanning mechanism, capable of sensing, by the color, magnetic, or visual indicia placed upon the key or key tag, which indicates the group to which the key belongs. Such a scanning mechanism is illustrated in FIG. 12. The scanning mechanism, senses the code of the key and is provided with suitable data processing equipment, which will provide a signal capable of operating selected one of the rotary magnets, whereby the given key can be diverted to the appropriate corresponding secondary rail 122, 124, etc.

The apparatus illustrated in FIGS. 9 and 10 operates in the following manner:

The user, on returning the key, slips the tag 26 over the end of the main rail 120, as explained previously with regard to FIG. 1. The key slides downwardly along the main rail 21 until it passes the scanning device, where the code is sensed either magnetically or photoelectrically and the nature and destination of the key is determined. After the scanning the tag, the key is released by the scanning device and it slides along the main rail 120 toward the first light barrier 134, preceeding the first pivotal section 126 of the rail. The scanning device is connected with all of the rotary magnets 130 and in accordance with the sensed code, passes a signal to the particular rotary magnet, corresponding to the destination read by the sensing means. If, for example, the key 28 is destined to be placed on the secondary rail 122, the signal from the sensing means is passed to the magnet 130 corresponding to the first pivotal rail section 126. This signal is passed to the rotary magnet prior to the movement of the key passed the light barrier 134 and presets the rotary magnet for action, so that when the tag 26 passes the light barrier 134, prior to the pivotal rail section 126, a second signal is produced, by the photo cell housed therein, which after a predetermined delay, activates the rotary magnet 130, so that the pivotal rail section 126 is caused to pivot until it strikes the fixed stop 126 on the secondary rail 122 and becomes aligned with it.

The pivotal rail section 126 and the secondary rail 122 then form, as is shown in FIG. 10, a continuous rail having the same slope, so that the key can slide from the pivotal rail section 126 to the secondary rail 122 without any difficulty. The secondary rail 122 can lead directly to the ejector roller, described in connection with FIG. 1 and can itself form an intermediate magazine for the storage of particular groups of keys for later transfer to the ejector roller.

The pretriggering of the rotary magnet by the sensing device and the subsequent pulse signal derived from the light barrier 34, insures that the proper destination of the key is determined and its presence on the appropriate pivotal section 128, 128, etc. is determined prior to the movement of the key onto the pivotal sections itself. The built-in delay, in the operation of the pulse signal, from the light barrier 34 serves to insure, that the key is on the pivotal portion of the rail prior to the rotation of the rail itself. This delay can be adjusted, so that the key is precisely in the middle of the pivotal rail section at the start of its rotation. At this point, the sliding movement of the key is in fact halted or braked due to the rotation of the pivotal rail section, and it does not begin to slide until the pivotal rail section is again stationary and a continuous connection and alignment has been established with the secondary rail. If necessary, or considered desirable, a mechanical stop can be provided at the end of each of the respective pivotable rail sections, which is adapted to engage the key once the rail section is caused to rotate, thus preventing the key from falling off. The stop can be mechanically or electrically operated, so that it is removed on striking the flange stop 138, fixed at the end of the secondary rail. A simple spring loaded pin extending laterally from a portion of the pivotable rail section can be employed, which pin is depressed and retracted upon engagement with the flange 138 allowing the key to move freely.

The angle of rotation, for each of the pivotal rail sections, is preferably 90°, but other angles are possible. In fact, the pivotable rail sections can be actuated to index through two or more angles, so as to align itself with more than one secondary rail.

It will be obvious, that the key, will slide past each of the individual pivotable rail sections and through all of the light barriers until it reaches that portion of the rail wherein the corresponding rotary magnet has been pretriggered by the sensing means. Thus, the pivotable rail section will only be caused to move under the simultaneous combination of signals from the scanning device and from the appropriate light barrier 134 corresponding to it. To insure the sequential sensing of the key, and the alignment of the pivotable rail sections 126, 128 etc. with the main rail, means are provided at the sensing device or prior thereto, for forwarding the keys one by one to the sensing and subsequent diverting operations.

In FIG. 11, a modification of the apparatus shown in FIGS. 9 and 10 is illustrated. This modification has several advantages in that it is smaller and thus space-saving than the earlier embodiment, and that it employs only a single rotary magnet. In this embodiment, the main rail 120 is followed only by one pivotal rail section 126a which similarly is pivoted by a rotary magnet 130 to which a central shaft and clamp 136 is connected along the vertical axis 135. Mounted to the bracket 136 is a selectively operable barrier mechanism 140 adapted normally to prevent the movement of a key beyond the end of a single pivotal rail section 126*a*. The barrier mechanism may comprise a singer movable under action of a solenoid or similar remote-control motive means into and out of movement of the tag depending from the rail 126*a*. As in the embodiment of FIGS. 9 and 10, a number of secondary rails 122, 124 etc. are provided, each having a stop flange 138. The rotary magnetic motor 130 is mounted at the bottom end of a supporting bracket 152 which is mounted on the outer housing of a reversible indexing. motor 142. The motor 142 is adapted to travel on a horizontal guide way 144 which is provided with one elongated rack. The output of the indexing motor 142 is provided with a pinion 146 which enmeshes with the rack. The motor 142 can be activated, by remote signal and caused to travel horizontally along the guide way 144, carrying the rotary magnet 130 to alignment with one or the other of the secondary rails 122, 124, etc.

The apparatus seen in FIG. 11 shows the tag 26 for a key 28 which is slipped over the end of the main rail 120, as previously described and is caused to slide by a scanning device, such as that shown in FIG. 12, by which the code of the key is sensed. After the release of the key from the scanning device, the key slides onto the pivotal rail section 126a where it strikes the barrier 140 and comes to rest. The scanning device has meanwhile passed a control pulse or signal derived from the code of the tag, to the indexing motor 142. This control pulse is fed to the indexing motor 142, with an appropriate delay, in order to insure that the key has in fact be centered to the pivotal rail section 126a. Thereafter, the indexing motor 142 is set in motion, to carry the pivotal rail section 126a, bodily into alignment with the appropriate secondary rail 122, or 124, etc. on which is to be finally arrayed, the key having the code in question. When the indexing motor 142 has reached the appropriate secondary rail, on which the key is to be stored, the indexing motor 142 stops. The stopping of the indexing motor 142, simultaneously creates a pulse, which if necessary, is also provided with a time delay, set to the rotary magnet 130, which causes the rotary magnet 130 to pivot the shaft 136 and the rail section 126a until the latter strikes the flange stop 138 of the secondary rail in question. The pivoting of the rail section 126a in this manner thus establishes direct communication of the rail section with the appropriate one of the secondary rails 122 and 124, etc., which of course lie at the same slope or angle of inclination with each other as previously described.

Once the rail section 126a engages the flange stop 138, the barrier 140 is unlocked by an appropriate signal, so that the key can slide into the secondary rail. The secondary rails are provided with a control device, preferably a photocell, which senses the movement of the key along the secondary rail. This control device produces a signal, which is fed first to the rotary magnet 130 and then to the indexing motor 146 whereby the pivotal rail section 126*a* can be re-pivoted to its initial position and translated and carried into direct alignment and connection with the main rail 120, as seen in FIG. 11. A similar control device located on the secondary rails 122 and 124, is used in the embodiment of FIGS. 9 and 10, to return or re-pivot the respective one of the rotary magnets which was originally pivoted as a result of the combination of signals from the photo cell 124 and the coding sensor means. In either instance, the control device is located on the secondary rails, preferably photo cells can be adjusted to determine the number of keys located thereon, so that when such number has been received, no further keys will be fed to the particular secondary rail. In either the embodiments of FIGS. 9 and 10 or that of FIG. 11, when this condition has been reached, the keys can be forwarded to anyone of the other appropriately grouped secondary rail.

FIG. 12 illustrates a scanning and sensing device which may be used to sense the key code in connection with anyone of the preceeding described embodiments.

The scanning device generally illustrated by the numeral 152, as seen in FIG. 1, is arranged adjacent the suitable portion of an intake rail, such as the main intake rail 120, illustrated in FIGS. 9 to 11. The device consists generally of two sensors 154 and 158, which are mounted in spaced apart relationship to each other in the longitudinal direction of the rail 120. The sensor 154 is pivoted about an axis 156, so as to be movable, in the direction of arrows P1 between a position extending transversely to the rail 20 and a position indicated by the dotted lines 155 parallel to the rail 120 and above its upper end. The sensor 158 is similarly pivoted about an axis 160, so as to movable in the direction of the arrow P2 into a position in which is also normal to the rail 120 and a second position, indicated by the dotted lines 159, parallel to the rail 120, but extending in an opposite direction from that of the second position 155 of the other sensor 154. In the second position 155 and 159, respective sensors are pivoted out of the path of the movement of the keys or the tags 26 attached to the keys. This position may be called an inactive position. In the position illustrated in full lines in FIG. 12, the scanners 154 and 158 protrude into the path of the tags 26 and are spaced apart such a distance that they are capable of receiving between the sensors 154 and 158 the tag 26.

The scanning device operates as follows:

In an initial starting position, the scanner 154, being downstream of the flow of keys on the rail 120, is maintained in the position indicated by the full lines so that it protrudes into the path of the keys. The scanner 158, lying the upstream side, is initially maintained in the inactive position 159 so that a key, when placed onto the rail 120 can slide freely on the rail until it strikes the forward sensor 154. When this occurs, the upstream sensor 158 moves from its inactive position into the active position shown in the full lines in the figure. In this active position the upstream sensor 158 also protrudes into the path of the movement of the keys on the rail 20 and sandwiches the key between it and the forward sensor 154. In this position the code contained on the tag 26 can thus be determined.

The code, located on the tag 26 can for example be a perforated diagram of predetermined configuration, through which a predetermined light array can be transmitted. The scanning device is thus provided with an appropriate source of light on one side of one of the sensing members 154 or 158 and a corresponding photosensitive photo cell or plurality of photo cells, on the side of the other sensor. The light source, and the photo cells are conventional in nature and are therefore not specifically shown in FIG. 12. However, it will be apparent that the arrangement is capable of determining predetermined codes via the passage of a predetermined array of light through the sensors 154 and 158 and the tag 26 created by the coincidence and alignment of the preforations formed in each. Preferably the sensors 154 and 158 will have a uniform matrix of perforations while the tag 26 would be provided with only a predetermined array indicative of the coding.

After scanning the predetermined array on the tag 26 and determining the specific code, the photo cells will produce sufficient signals and pulses, which may be fed to data processing apparatus, for further operation of the equipment with the use of conventional means. Thus after the scanning, the sensor 154, down stream of the rail 20 is returned to its inactive position 155 and is pivoted out of the path of the key so that the key will be permitted to slide downwardly on the rail toward the pivotal rail sections 126, 128 or 126a etc. Simultaneously the scanning device 152 produces a control signal which is either forwarded to the corresponding rotary magnetic of one of the number shown in FIG. 9, to pre-trigger it, or to the indexing motor shown in FIG. 11 so as to move the same toward the appropriate secondary rail. After the key has passed the scanning device 152, the sensor 154 pivots from its inactive position 155 back into its active or working position, shown in the dotted lines where it is again placed across the path of the keys along the rail 152. Simultaneously the sensor 158 is pivoted into its inactive position 159, so that the next key can be received by the scanning device and its code determined. It is preferable here, although this is not shown in the drawing, to provide means upstream of the sensing device 152 by which the keys can be separated and moved one by one into the scanning device so that only one key at a time will be lodged between the sensors 154 and 158. An ejector roller, similar to the one shown in FIG. 1 can be used for this purpose, which ejection roller is also triggered and activated by a pulse signal from the sensor 152.

The apparatus shown in FIG. 11 can also be used advantageously for the issuance of keys to a customer, as well as for the distribution of keys onto storage rails. In this situation, the apparatus can be employed to obtain from any one of the individual key storage rails, i.e. the secondary rails 122, 124 etc. a key and allow it to fall or propell it onto a delivery shaft where it can be picked up by the customer. The control pulse for the indexing motor is not triggered in this instance by a scanning device or by a sensing means but by operation of a push button or similar switch device by the customer himself. The customer activates the push botton or switch device of a particular group, for instance "men" or "women" in order to obtain a key from the group that is provided for the corresponding facility. After receiving the control order, the indexing motor moves into a position in alignment with the corresponding secondary rail, but at its lower end. For this purpose, the position of the horizontal guide rail for the motor will be placed such that the rail 126a will be able to traverse across the arrangements of secondary rails 122, 124 etc. and stop in alignment with such rails at their lower end. Once the pivotal rail **126*a* is aligned with a particular secondary rail, it then collects a key, which has been ejected from the secondary rail by a delivery device such as the ejector roller shown in FIG. 1, which has likewise been triggered to operate, upon the alignment of the pivotal rail 126*a* by the original activation of the push button or switch by the customer. It will be appreciated therefore that the secondary rails, in this embodiment, would not end at the ejector roller 18, as shown in FIG. 1 but will run under this ejector and pass the roller to a terminal end adjacent to the position to be taken by the movable and pivotable sections 126*a*, so that the key will continue to slide by its own weight once it has been separated by the ejector roller. The key is then received at the lower end of the pivotal rail section 126 and is held thereon until the indexing motor is movable to a delivery chute remote from the secondary rail from which the key is taken and thereafter releases the key to the customer by releasing the barrier lock 140. Thus, a single movable and pivotable rail section 126*a*** may be traversed between a number of secondary storage rails each having peculiar set of keys, receive a key thereon, and carry the key to a single dispensing rail for direct issuance to the customer.

From the foregoing, it will be seen that the numerous objects and advantages of the present invention have been obtained by a rather simple and unique apparatus, easily operable and simply constructed. Various modifications, changes and embodiments have been suggested in the disclosure, others will be obvious to those skilled in the present art. It is accordingly intended that the present disclosure by taken as illustrative only of the invention and not limiting of its scope.

What is claimed is:

1. A system for storing and dispensing keys comprising, a storage rail having an entry terminal at one end and an exit terminal at the other end and a length sufficient to store a plurality of keys successively therealong, said keys having means for slidably suspending each from said rail, said key having predetermined code means indicative of the nature of the keys to be stored on said storage rail, selection means located at the entry terminal to said storage rail operative to permit only keys having the predetermined code means to be introduced onto said storage, dispensing means located adjacent said rail prior to said exit terminal for engaging at least the leading one of said keys, said dispensing means being actuable to separate the leading key from the succeeding keys causing it to move toward the exit terminal, for separation therefrom.

2. The system according to claim 1, in which said dispensing means comprises a rotatable roller having a slot defining a key gripping edge on its peripheral surface, the rotation of said roller causing said edge to engage the leading key and to move the same along said storage rail, while the peripheral surface of said roller, engages the next succeeding key preventing it from moving along said storage rail.

3. The system according to claim 2, in which said storage rail is inclined to slope toward said roller thereby causing said keys to normally slide into engagement with said roller.

4. The system according to claim 1, wherein said key includes a tag at one end, said tag having an aperture adapted to axially fit and slide over said storage rail and containing said predetermined code means.

5. The system according to claim 4 wherein said tag is integral with said key.

6. The system according to claim 4 wherein said tag is separable from said key.

7. The system according to claim 4, wherein the cross-section of said rail has an I shape and said aperture comprises a circular hole having a radial slit extending therefrom, said hole fitting over a base of the I cross section and said slit straddling the stem of I cross-section.

8. The automatic key storing and dispensing system according to claim 4, wherein an auxiliary rail is positioned prior to the entry terminal of said storage rail and in communication therewith, said auxiliary rail having a form conforming to the shape of said storage rail and said key aperture to receive said key and permit said key to be transferred to said storage rail, said selection means being associated with said auxiliary rail.

9. The system according to claim 8, in which said auxiliary rail and said key carry cooperable code means determinative of the nature of said keys to be stored on said storage rail, and means for permitting the transfer only of keys having a predetermined code to said storage rail.

10. The system according to claim 9, in which said code means comprise projections and cavities cooperably formed on said auxiliary rail and said key.

11. The system according to claim 1 wherein said dispensing means is electrically operable and includes switch means connected to said dispensing means for controlling the operation of said dispensing means to dispense only one key at a time.

12. The system according to claim 1, in which said storage rail comprises a substantially horizontal section, and an inclined section leading to said exit terminal and said dispensing means comprises a catch movable adjacent said horizontal section and selectively operable to engage said keys and forward them along said horizontal section to the inclined section, and motor means for driving said catch.

13. The system according to claim 12 wherein said catch is adjustable between an idle position and a working position and having means selectively projecting said catch into the working position to engage the key.

14. The system according to claim 12, wherein said catch is attached to an endless belt arranged to be driven in an endless path, a portion of which is positioned parallel and adjacent to said horizontal section of said storage rail.

15. The system according to claim 12 including biasing means for normally maintaining said catch in its working position and means for selectively overcoming said biasing means during movement of said belt.

16. The system according to claim 15 wherein said biasing means is magnetic.

17. The system according to claim 16 wherein said catch comprises an elongated finger pivotally connected to said belt, magnetic means located on said belt to normally bias said finger transversely outward of said belt into the working position toward said storage rail, stop means selectively positionable adjacent said storage rail operable to engage and pivot said finger against the bias of said magnetic means into the idle position away from said storage rail.

18. The system according to claim 17 including a return means positioned adjacent said horizontal section to pivot said finger back to its working position.

19. The system according to claim 18, in which said return means is a stop.

20. The system according to claim 18, in which said return means is a magnet.

21. The automatic key storing and dispensing system according to claim 18 including means for controlling the operation of said return means in response to the separation and dispensing of one of the keys from said storage rail.

22. The system according to claim 1 wherein said storage rail includes a helicoidal section, and said dispensing means comprises a shaft coaxially positioned within said helicoidal section and having a catch coupled thereto pivotal between an idle and a working position, projecting in its working position adjacent the helicoidal section and means for moving said catch along said shaft from one end of said helicoidal section to the other.

23. The system according to claim 22 wherein said shaft is rotatable and including motor means for rotating the same, said catch being coupled to said shaft to move axially therealong and to rotate about the axis of said shaft in response to the rotation of said shaft.

24. The system according to claim 23, in which said motor shaft comprises a hollow cylinder, extending in a substantially vertical position, said cylinder being provided at its top with a rotary pulley and having in its interior an adjustable weight suspended on a rope led around said pulley and fixed at its other end to a movable support axially slidable along said shaft, said catch being connected to said support.

25. The system according to claim 24, in which a stop is provided at the lower end of said helicoidal section in a position such that, on contact therewith, said catch pivots to its idle position.

26. The system according to claim 22, in which a stop is provided at the upper end of said helicoidal section in a position such that, on contact therewith, said catch pivots into its working position.

27. The system according to claim 1, including a plurality of secondary rails each of which form a single key storing and dispensing rail, said storage rail having at least one pivotal rail section operable to communicate with a selected one of said secondary rails.

28. The automatic key storing and dispensing apparatus according to claim 27 including magnetic actuating means for moving said pivotal storage rail section.

29. The system according to claim 28, including key sensing means located on at least one of said storage rail, said pivotal rail section and each of said secondary rails, said actuating means being operable in response to a selected signal from said key sensing means.

30. The system according to claim 27, wherein the number of pivotal rail sections is identical with the number of said secondary rails.

31. The system according to claim 30, in which said pivotal rail sections are arranged sequentially subsequent to one another.

32. The system according to claim 31, in which said storage rail and pivotal rail sections and said secondary rails are positioned in a plane inclined at a predetermined angle from the horizontal.

33. The system according to claim 28 including switch means arranged at the entry of each pivotal rail section for operating said magnetic actuating means.

34. The system according to claim 33, in which said switch means is operable in response to the passage of a key therethrough.

35. The automatic key storing and dispensing apparatus according to claim 33, in which said switch means is operable with a predetermined time delay.

36. The automatic key storing and dispensing apparatus according to claim 33 in which said switch means is operable in response to a photo sensor.

37. The system according to claim 28 including a stepping motor, means coupling said magnet to said stepping motor to revolve the same, control means for displacing said stepping motor to thereby swing said pivotal rail section in substantially horizontal plane to a selected one of said group rails.

38. The system according to claim 24 including stop means located at the end of each pivotal rail for blocking passage of keys said pivotal rail and means positioned adjacent said second secondary rails to remove said stop when said pivotal rail has been moved into alignment therewith.

39. The system according to claim 38, in which said sensing means comprises a pair of mutually spaced detectors swingably arranged adjacent said rail and adapted to permit the key to pass therebetween and be sensed in order to determine the secondary rail whereto the key involved shall be directed.

40. The system according to claim 1 wherein said selection means is responsive to indicia means on said key for defining the nature and/or use thereof, and includes means for sensing said indicia and providing an electrical signal indicative thereof.

41. The system according to claim 40 wherein said indicia is optical and said means for sensing said indicia comprises a photo cell.

* * * * *